United States Patent [19]

Plummer

[11] 4,126,954

[45] Nov. 28, 1978

[54] GUN SHELL CONVERTER

[76] Inventor: Edward Plummer, 1623 Hagley Rd., Toledo, Ohio 43612

[21] Appl. No.: 859,004

[22] Filed: Dec. 9, 1977

[51] Int. Cl.[2] ..... F41C 21/10; F42B 5/22

[52] U.S. Cl. ..... 42/77; 102/41

[58] Field of Search ..... 42/77; 102/41

[56] References Cited

U.S. PATENT DOCUMENTS

| | | | |
|---|---|---|---|
| 271,883 | 2/1883 | Martin | 42/77 |
| 631,399 | 8/1899 | Gillette | 42/77 |
| 1,179,021 | 4/1916 | Mayer | 42/77 |
| 3,078,800 | 2/1963 | Bumiller | 42/77 |
| 3,384,989 | 5/1968 | Thomas | 42/77 |

*Primary Examiner*—Charles T. Jordan

*Attorney, Agent, or Firm*—Hugh Adam Kirk

[57] ABSTRACT

A durable plastic sleeve which simulates a larger gauge gun ammunition shell and has forced-fit metal sleeve insert at one end for seating the firing end of a smaller gauge gun shell and has a restricted other end for frictionally gripping the other end of the smaller gauge shell.

12 Claims, 5 Drawing Figures

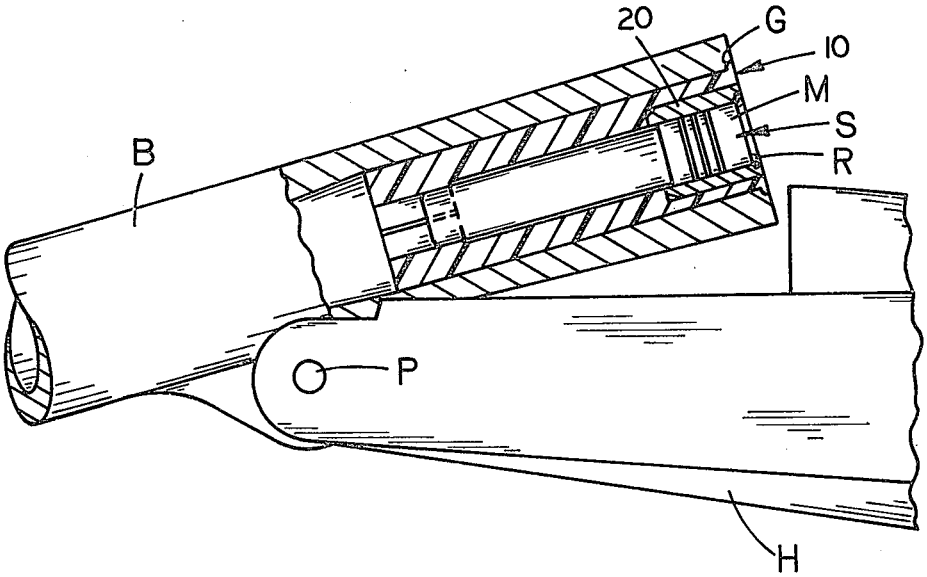
FIG. I
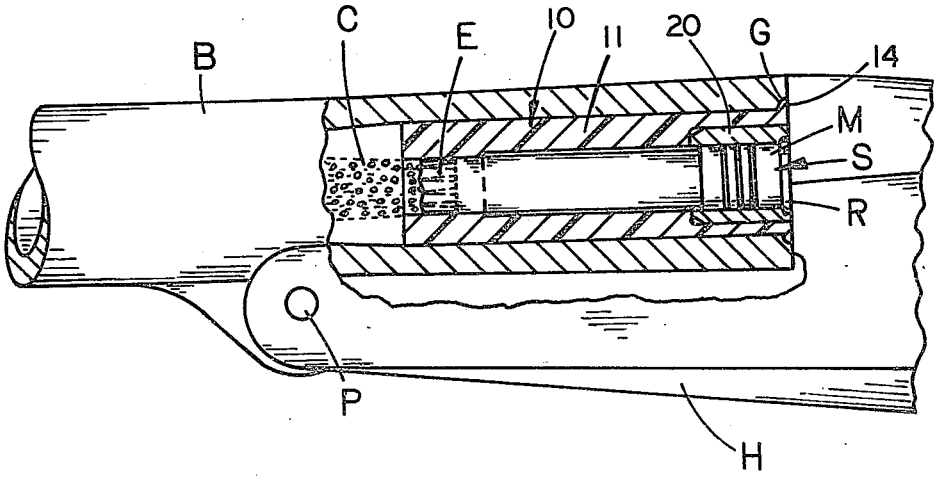
FIG. II

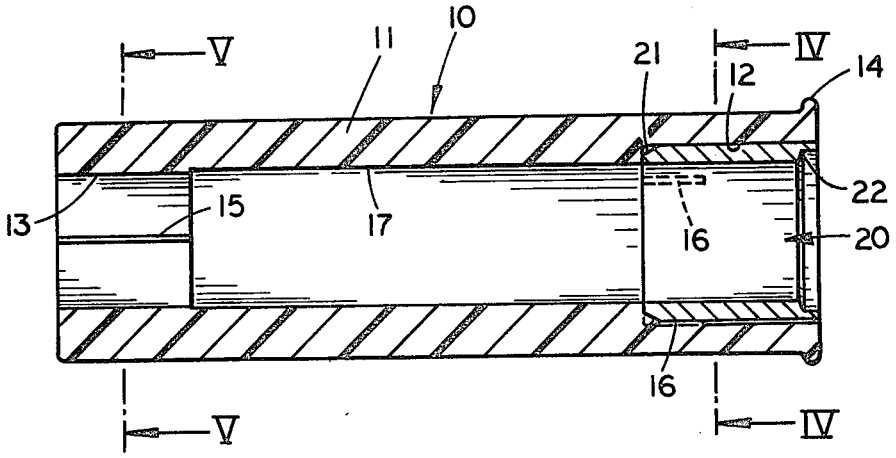
FIG. III
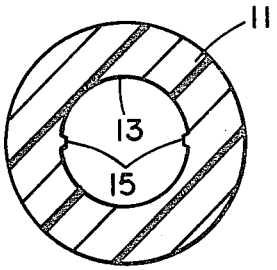
FIG. V
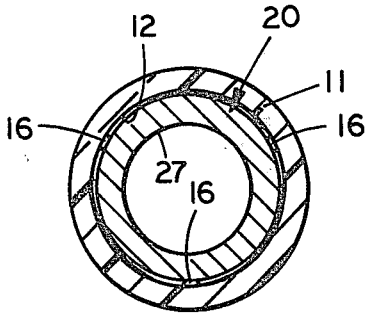
FIG. IV

GUN SHELL CONVERTER

BACKGROUND OF THE INVENTION

Converters for adapting larger gauge guns for shooting smaller gauge ammunition shells have long been known, such as taught by Mayer U.S. Pat. No. 1,179,021 issued Apr. 11, 1916, including disposable adapters made of plastic as disclosed in Bumiller U.S. Pat. No. 3,078,800 issued Feb. 26, 1963. A common adapter for converting 12 gauge shotguns to .410 gauge which is available on the market and comprises a metal tube several times the length of a 12 gauge shotgun shell, is disclosed in Knode Jr. et al. U.S. Pat. No. 3,339,304 issued Sept. 5, 1967.

These prior art converters or adapters are heavy and bulky, or not reusable, plus the fact that they are not adaptable to all types of actions, and particularly pump and semi-automatic guns.

SUMMARY OF THE INVENTION

Generally speaking, the converter of this invention comprises a plastic sleeve or tube slightly longer than the length of the larger gauge ammunition shell it is to simulate, but preferably not as long as that shell when it has been opened or discharged. Thus a plurality of the converters or adapters of this invention can be loaded in a magazine of an automatic gun as larger gauge shells are. This larger gauge shell simulated plastic sleeve has an outwardly extending flange at one end corresponding to the base rim of the larger gauge shell and also has at the same end a tight forced-fitting metal insert sleeve extending about one-fifth the length of the sleeve, which insert has a peripheral groove for seating and surrounding the metal base end and rim of the smaller gauge shell for which the adapter is to be used. This metal sleeve insert compensates for any expansion of the plastic sleeve due to the temperature rise when firing the smaller gauge shell in the adapter. The other inner end of this plastic sleeve has a reduced internal section, also about one-fifth the length to frictionally engage the other or opening end of the smaller gauge shell to keep it from sliding out of the plastic sleeve adapter or converter. In order to facilitate the engagement of both the tight-fitting metal sleeve insert and for better frictionally engaging the opening end of the smaller gauge shell, these internal end sections of the plastic sleeve may be provided with a plurality of longitudinal or axially parallel radially inwardly extending ribs which may extend the full or only partially the length of these sections. The inserted outer peripheral edge of the metal insert sleeve is preferably bevelled for ease in assembly into the enlarged end section of the plastic sleeve into which it fits. The internal cylindrical surface of this metal sleeve is a continuation of the internal cylindrical surface of the central major portion of the plastic sleeve.

Thus a 12 gauge shotgun can be adapted to shoot .410 gauge shells by means of the converter or adapter according to this invention, which adapter may be used in any single-shot, pump action, or automatic 12 gauge shotgun. However, the power of such smaller gauge .410 shells is usually not sufficient to operate the automatic ejection mechanism of an automatic gun so that the adapters or converters according to this invention are only used semi-automatically therein, which has an additional safety factor, particularly for the training of novices in the use of shotguns.

OBJECTS AND ADVANTAGES

Accordingly, it is an object of this invention to produce an efficient, effective, economic, durable, reusable, universal, safe, short, lightweight, simple converter for larger gauge guns to use smaller gauge ammunition or shells.

Another object is to produce such an adapter enables substantially the same amount of noise to be produced by the smaller gauge shell as that of the larger gauge shell, but without the recoil produced by the larger gauge shell, and still produce a shot pattern at least as good as if not better than that produced by the shot from a larger gauge shell.

Another object of this invention is to produce such an adapter which may be plugged with a rubber stopper for dry firing of the gun without harm to the firing mechanism thereof.

Still another object is to produce a converter for larger gauge shotguns to use smaller and cheaper ammunition or shells for target shooting, practice, shooting, hunting smaller game, and stopping wounded game without spoiling the meat thereof.

BRIEF DESCRIPTION OF THE VIEWS

The above mentioned and other features, objects and advantages, and a manner of attaining them are described more specifically below by reference to an embodiment of this invention shown in the accompanying drawings wherein:

FIG. I is a broken-open section of a single shot shotgun showing a longitudinally sectioned ammunition converter according to this invention inserted to the breech of the barrel of the shotgun;

FIG. II is a view similar section to FIG. I showing the shotgun closed and firing of the smaller gauge ammunition in the adapter or converter therein;

FIG. III is an enlarged longitudinal sectional view of the adapter shown in FIGS. I and II;

FIG. IV is a sectional view taken along line IV—IV of FIG. III showing the deformable ribs for gripping the metal sleeve in the end of the adapter; and FIG. V is a sectional view taken along line V—V of FIG. III showing the ribs in the reduced section for holding the smaller gauge ammunition in the converter.

DETAILED DESCRIPTION OF A PREFERRED EMBODIMENT

In FIGS. I and II there is shown the forward end of the handle portion H of a single-shot break-open shotgun to which the breech end of the barrel B is pivoted at pivot P. The breech end of the barrel B is sectioned to show the shell converter 10 of this invention located therein as would be the larger gauge ammunition for this gun barrel B, such as for example a 12 gauge shotgun shell. Inside this converter 10 there is shown a smaller gauge shell S, such as for example a .410 ammunition shell, unfired in FIG. I and firing a charge of shot C in FIG. II, so that the outer open end E of the shell S is shown to be completely enclosed in the converter 10 for easy removal of the empty shell S from the converter 10, such as by means of the reverse insertion of another shell S.

Referring more specifically to the converter or adapter 10 as also shown in FIGS. III, IV and V, this converter 10 comprises a plastic sleeve portion 11 having an enlarged internal rear end section 12, a reduced internal forward end section 13, and a rear outwardly extending rim or flange 14 for simulating the flange base or rim of the larger sized ammunition shell which fits into the annular groove G in the end of the breech of barrel B as shown in FIGS. I and II. The plastic of this sleeve 11 is preferably durable and has a low coefficient of expansion, such as for example a polycarbonate, however other plastics having similar physical properties may be employed without departing from the scope of this invention.

In order to insure the friction grip of the outer end of the smaller gauge shell S, the reduced internal cylindrical section 13 may be provided with a plurality of slightly radially inwardly extending ribs 15 parallel to the axis of the sleeve 11 (see also FIG. V), which ribs 15 may extend the full length of the reduced section 13. This reduced section 13 is preferably about one-fifth more or less of the full length of the sleeve 11. The enlarged internal section 12 may also be provided with a plurality of ribs 16 which preferably are at least at the inner end of this section for more firmly gripping the metal sleeve insert 20.

The metal insert 20 has an outer diameter substantially the same as the inside diameter of the enlarged internal section 12 and has at its inner outer peripheral edge 21 bevelled to aid in the insertion and force- or press-fitting or seating of the sleeve 20 into the enlarged section 12 for its anchoring therein. The length of this sleeve 20 is substantially the same as the length of the section 12 which is about one-fifth or more of the length of the converter 10 and preferably slightly longer than the length of the metal end M on the smaller ammunition shell S (see FIGS. I and II). The outer inner peripheral edge of the sleeve 12 is provided with a groove 22 similar to the groove G in the barrel B for the base rim R of the smaller shell S so that the smaller gauge shell S fits into the adapter 10 in the same manner as it would into the breech of a gun manufactured for the shooting of this smaller gauge ammunition shell S. Preferably this metal sleeve 20 is made of steel tubing and machined internally for accurate seating the metal base end M and rim R of the shell S. Preferably also this sleeve 20 is coated to prevent its oxidation or rusting, such as being cadmium plated or the like before the sleeve 20 is forced-fit into the enlarged section 12 of plastic sleeve 11. The internal cylindrical surface 27 of the metal insert sleeve 20 is the same and forms a continuation of the internal surface 17 of the plastic sleeve 11 between its enlarged and reduced end sections 12 and 13.

Although the embodiment shown in this description is that for a converter or adapter of a 12 gauge shotgun to use .410 ammunition, it is to be clearly understood that the adapter having the features of this invention can be made of different diameters, thickness and lengths for converting or adapting other guns for larger ammunition to use smaller ammunition. In each case, however, the external diameter and length of the converter or adapter 10 would simulate that of the larger ammunition, while the internal diameter of the converter 10 would simulate that of the breech of the barrel into which the smaller ammunition would be placed for firing.

While there is described above the principles of this invention in connection with a specific device, it is to be clearly understood that this description is made only as a way of example and not as a limitation to the scope of this invention.

I claim:

1. A converter for using a smaller gauge ammunition shell in a larger gauge gun comprising:

(A) a cylindrical plastic sleeve having an outer diameter and length simulating the ammunition for the larger gauge gun with an outwardly extending flange portion around one end of said sleeve to correspond to the base rim of the larger gauge ammunition shell, and having an inner cylindrical hollow portion simulating the outer cylindrical surface of the smaller gauge ammunition shell and having a reduced longitudinally ribbed section at one end for frictionally engaging the opening end of said smaller gauge shell, and (B) a metal sleeve inserted in the other end of said plastic sleeve having an outer groove for seating the base rim of the smaller gauge ammunition shell and surrounding the metal base portion of said smaller gauge shell.

2. A converter according to claim 1 wherein the length of said plastic sleeve is between that of the larger gauge shell when closed and when opened.

3. A converter according to claim 1 wherein said plastic sleeve has an enlarged other end section for seating and gripping said metal sleeve.

4. A converter according to claim 3 wherein said enlarged and reduced inner end sections of said sleeve are each provided with a plurality of longitudinal radially extending inwardly extending ribs.

5. A converter according to claim 3 wherein the inner outer peripheral edge of said metal sleeve is bevelled for facilitating press-fit assembly in said other enlarged end section of said plastic sleeve.

6. A converter according to claim 1 wherein said metal sleeve is coated to reduce its oxidation.

7. A converter according to claim 6 wherein said coating is cadmium.

8. An adapter for using a smaller gauge ammunition shell in a larger gauge gun comprising:

(A) a cylindrical plastic sleeve having:

(a) a length at least as long as the loaded larger gauge shell and shorter than the open larger gauge shell, (b) an enlarged inner one end section for about one-fifth the length of said sleeve, (c) a reduced inner other end section for about one-fifth the length of said sleeve to frictionally grip the opening end of the smaller gauge shell, (d) an outwardly extending flange portion around said one end to correspond to the base rim of the larger gauge shell, and (e) a plurality of longitudinal radially inwardly extending ribs in both said inner end sections; and (B) an inner cylindrical metal sleeve grippingly seated in said enlarged one end section of said plastic sleeve having:

(a) a groove around its outer end to seat the rim base of the smaller gauge shell, (b) a inner cylindrical surface forming a smooth continuation of the cylindrical inner surface of said plastic sleeve between said inner end sections, and (c) a bevelled outer inner peripheral edge.

9. An adapter according to claim 8 wherein said gun is a shotgun.

10. An adapter according to claim 8 wherein the ribs in said enlarged inner end section extend only partly the length thereof.

11. Tn adapter according to claim 8 wherein said metal sleeve is coated to reduce oxidation thereof.

12. An adapter according to claim 8 wherein said plastic sleeve is a polycarbonate.

* * * * *

UNITED STATES PATENT AND TRADEMARK OFFICE

CERTIFICATE OF CORRECTION

PATENT NO. : 4,126,954

DATED : November 28, 1978

INVENTOR(S) : Edward (NMI) Plummer

It is certified that error appears in the above-identified patent and that said Letters Patent are hereby corrected as shown below:

Column 2, line 8, after "adapter" insert - - which - - ; line 33, change "to" (second occurrence) to - - in - - .

Column 4, line 64, change "Tn" to - - An - - .

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*